US006189244B1

(12) United States Patent
Johnson et al.

(10) Patent No.: US 6,189,244 B1
(45) Date of Patent: Feb. 20, 2001

(54) SELF-CLEANING NARROW DITCH TRENCHER AND FLEXIBLE TILE INSTALLER

(76) Inventors: Randal Johnson, R.R. 2, Box 55, Gibbon, MN (US) 55335; Jay Hagberg, 32589 561st Ave., Lafayette, MN (US) 56054

( * ) Notice: Under 35 U.S.C. 154(b), the term of this patent shall be extended for 0 days.

(21) Appl. No.: 09/396,655

(22) Filed: Sep. 15, 1999

(51) Int. Cl.[7] ..... E02F 5/02

(52) U.S. Cl. ..... 37/349; 37/352; 37/462; 405/181

(58) Field of Search ..... 37/347, 349, 352, 37/91, 92, 189, 462, 464, 465; 405/180, 181, 179, 174

(56) References Cited

U.S. PATENT DOCUMENTS

| | | | | |
|---|---|---|---|---|
| 178,231 | | 6/1876 | Camptell . | |
| 2,414,994 | | 1/1947 | Wright . | |
| 3,332,249 | | 7/1967 | Idoine . | |
| 4,038,828 | | 8/1977 | Schuck et al. . | |
| 4,164,082 | * | 8/1979 | Watson | 37/83 |
| 4,232,982 | | 11/1980 | Satterwhite . | |
| 4,244,123 | | 1/1981 | Lazure et al. . | |
| 4,260,290 | | 4/1981 | Flippin . | |
| 4,326,347 | | 4/1982 | Ballinger . | |
| 4,397,585 | | 8/1983 | Fouss et al. . | |
| 4,629,363 | * | 12/1986 | Rose et al. | 405/155 |
| 4,637,755 | | 1/1987 | Tollefson et al. . | |
| 4,650,370 | | 3/1987 | Kassner et al. . | |
| 4,799,823 | | 1/1989 | Williams . | |
| 4,833,797 | * | 5/1989 | Slunecka et al. | 37/86 |
| 4,871,281 | | 10/1989 | Justice . | |
| 4,908,967 | * | 3/1990 | Leece | 37/192 A |
| 4,981,396 | | 1/1991 | Albertson et al. . | |
| 5,070,632 | * | 12/1991 | Gilbert | 37/90 |
| 5,090,141 | | 2/1992 | Hall . | |
| 5,108,229 | * | 4/1992 | Slanker | 405/181 |
| 5,224,797 | | 7/1993 | Vaughan . | |
| 5,320,451 | | 6/1994 | Garvey et al. . | |
| 5,421,108 | * | 6/1995 | Stewart | 37/142.5 |
| 5,596,822 | | 1/1997 | Desmarais et al. . | |
| 5,743,675 | | 4/1998 | Fluharty et al. . | |
| 5,827,013 | | 10/1998 | Fluharty et al. . | |
| 5,913,638 | * | 6/1999 | Lansdale | 405/179 |
| 6,059,447 | * | 5/2000 | Paris | 366/346 |
| 6,125,558 | * | 10/2000 | Stewart | 37/142.5 |

* cited by examiner

*Primary Examiner*—Victor Batson
(74) *Attorney, Agent, or Firm*—Roger W Jensen

(57) ABSTRACT

A narrow-trench earth trencher and flexible tube installer, including a relatively large diameter narrow driven sprocket connected by a chain with attached earth cutters to a relatively small drive sprocket. The trencher includes a carriage frame adapted to be connected to a pulling vehicle, with wheels at one end to facilitate horizontal travel. Mounted on the carriage frame are first and second vertically-oriented trencher frame assemblies. The trencher also includes a vertically-oriented tubular member and a crumber for helping place the flexible tubing in the trench.

13 Claims, 4 Drawing Sheets

FIG. 3
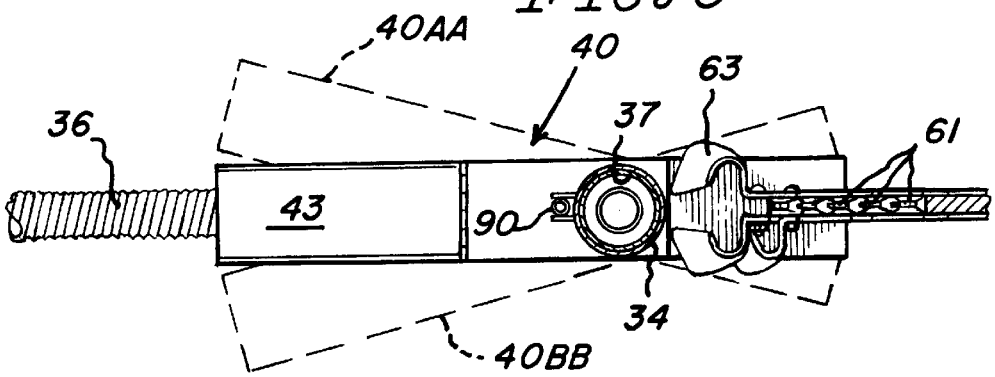
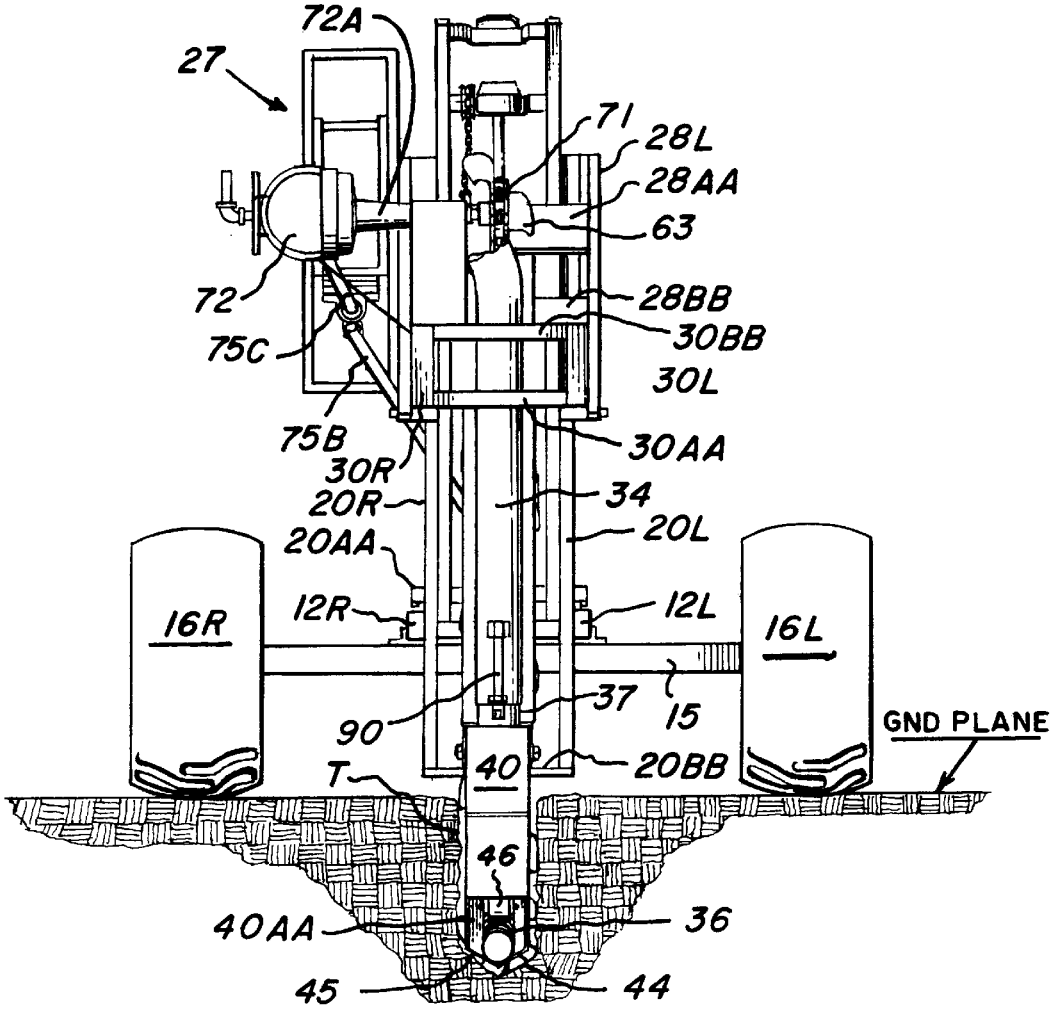
FIG. 4

SELF-CLEANING NARROW DITCH TRENCHER AND FLEXIBLE TILE INSTALLER

FIELD OF THE INVENTION

This invention relates to a ditch or trench excavating and flexible tile installation apparatus, and more specifically to an apparatus which continuously excavates a trench, simultaneously inserts or lays the flexible tile therein, and then refills the trench utilizing a driven continuous-chain with attached earth cutters, the chain/cutters being self cleaning.

There are a number of prior art machines for digging trenches or ditches, for installing flexible tile and pipelines, and for refilling the ditches after the pipeline has been installed. Representative examples of prior art systems are disclosed in U.S. Pat. Nos. 2,414,994; 3,332,249; 4,038,828; 4,232,982; 4,326,347; 4,871,281; 4,981,396; and 5,108,229.

One of the issues associated with machines of the types described is dealing with extremely heavy clay-like material which is to be excavated; such material tends to stick to or adhere to the cutters of the earthcutting mechanism. For example, U.S. Pat. No. 4,326,347 discloses a large-diameter wheel apparatus with attached cutters which, when dealing with heavy clay-like soil, would tend to get clogged so as to seriously reduce the efficiency of the operation.

The present invention, on the other hand, is of a unique design having a number of advantages over the prior art, one of which is the provision of automatic self-cleaning of the cutters, even with heavy clay-like soil.

SUMMARY OF THE INVENTION

The present invention provides an apparatus for trenching a narrow trench and simultaneously provides for the continuous laying of flexible tubing in the trench. A carriage frame is adapted to be connected to a pulling vehicle such as a tractor, and has wheel means at one end thereof so as to facilitate horizontal travel or locomotion of the carriage frame. Mounted on the carriage frame is a first generally vertically-oriented box frame assembly having movably attached thereto a second vertically-oriented trencher support or traveling frame assembly which supports one end of a pair of spaced-apart, horizontally-disposed elongated beams. A drive sprocket having a relatively small diameter is mounted on the horizontal beams, the beams further supporting a generally vertically-oriented driven sprocket support beam at the lower end of which is rotatably connected a driven sprocket having a relatively large diameter. The spaced-apart drive and driven sprockets are connected by a continuous chain, the chain having a plurality of earth cutters attached thereto. Means are provided for driving the drive sprocket to thereby cause movement of the chain and cutters and thus cause rotation of the driven sprocket. A vertically-oriented tubular member having a top open end for receiving flexible tile or tubing is supported by the horizontal beams, and a crumber means is attached to a bottom end thereof, the crumber means including outlet means though which flexible tile or tubing may exit.

The self-cleaning features of the present invention are the result of having a relatively small diameter drive sprocket which, in combination with an appropriate rotational speed of the drive sprocket, results in the chain with attached cutters having a relatively fast angular acceleration as the chain passes around the drive sprocket; the aforesaid acceleration tends to throw the earth held by the cutters off of the cutters and in a direction so as to fall into the ditch behind the trenching apparatus.

BRIEF DESCRIPTION OF THE DRAWING

FIG. 3 is a detail showing how the crumber 40 may be rotated relative to the rest of the apparatus;

FIG. 4 is a rear view of the apparatus as shown in FIG. 1 excepting, for clarity, the top portion of tubular member 34;

DETAILED DESCRIPTION OF THE INVENTION

Figure 1:
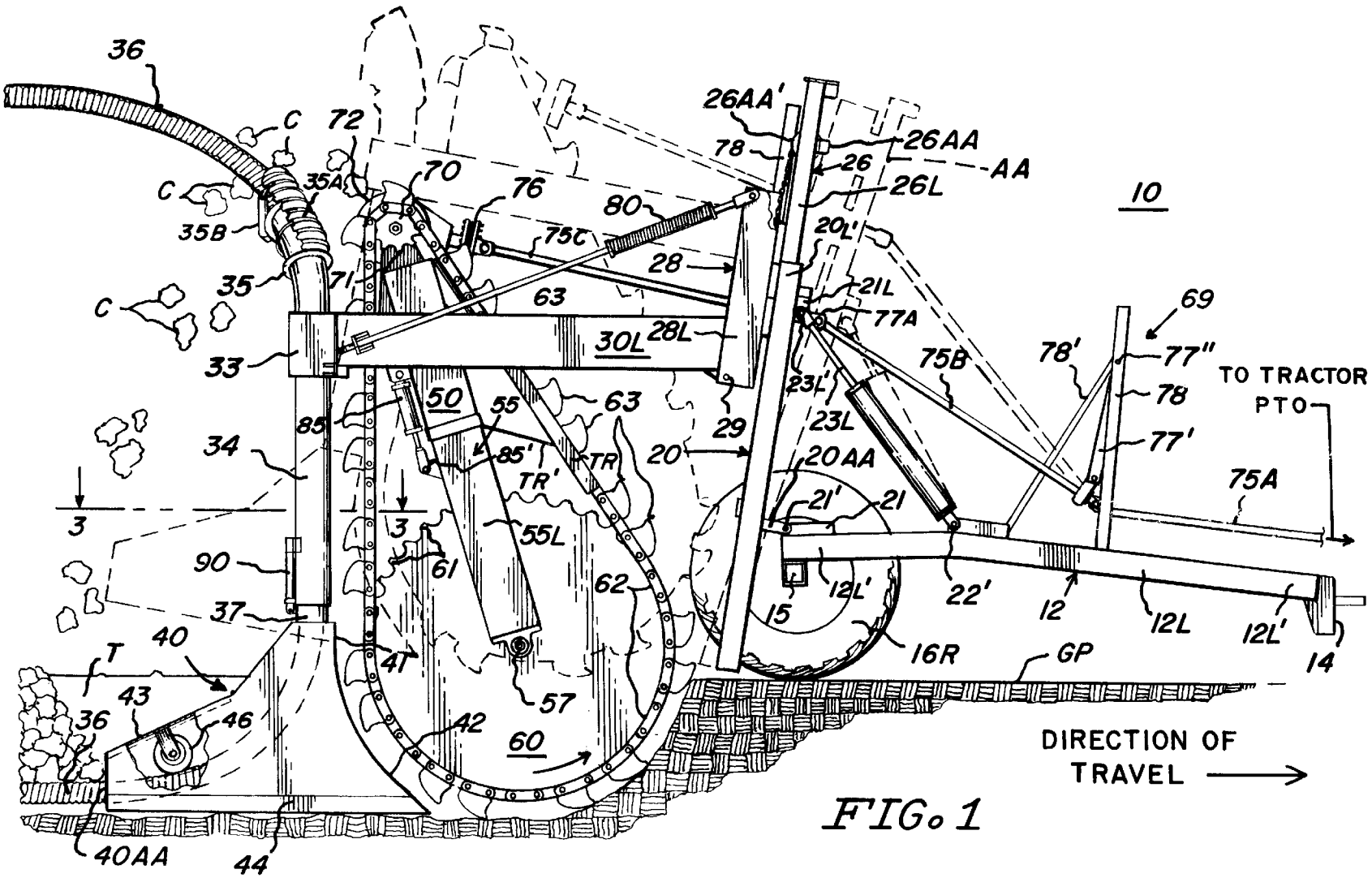
FIG. 1 is a side elevational view of a preferred embodiment of the invention excepting, for clarity, wheel 16L.
Figure 6:
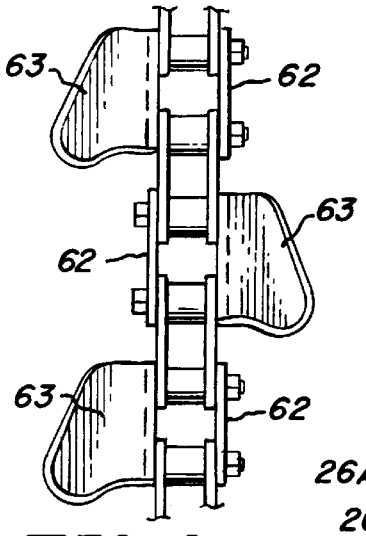
FIG. 6 is a detail showing the chain and cutter.
Figure 2:
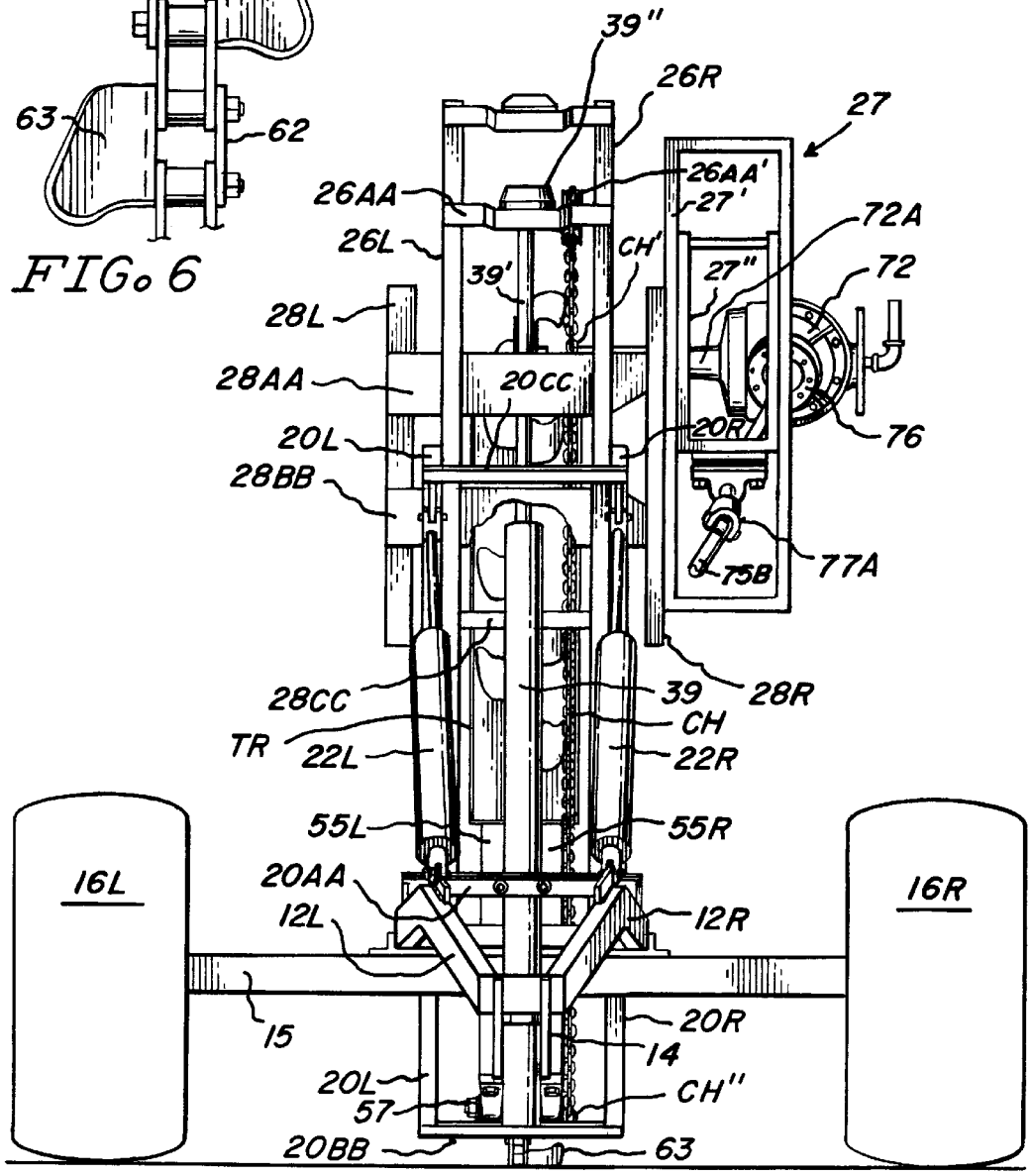
FIG. 2 is a somewhat enlarged front view of the apparatus shown in FIG. 1.

In FIG. 1 the reference numeral 10 designates a preferred embodiment of our invention. An elongated carriage frame 12 is horizontally oriented and comprises a pair of frame members or beams 12L and 12R disposed to the left and to the right as shown in FIG. 2, and being joined at the front ends 12L' to define a first end to which is connected a draw bar means 14 which is adapted to be connected to a pulling vehicle such as a tractor (not shown).

Figure 5:
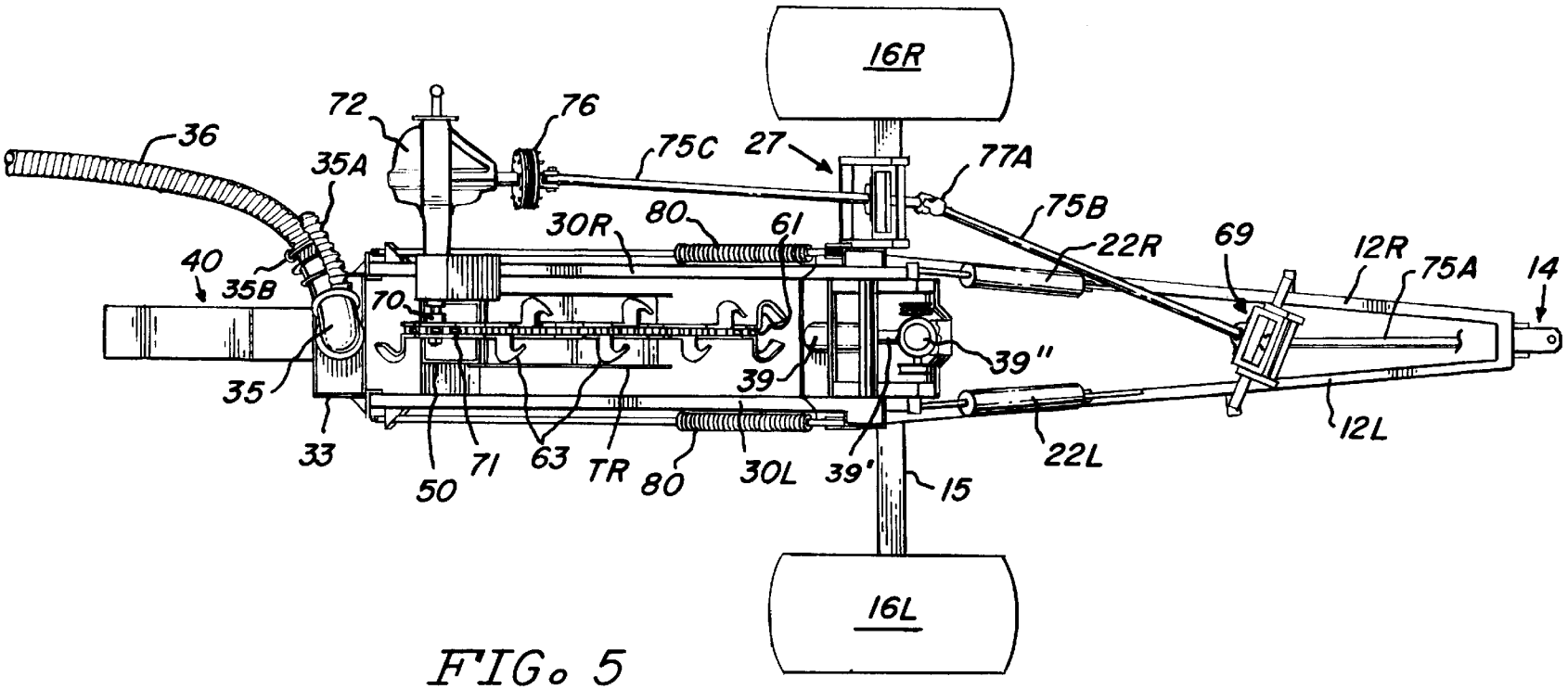
FIG. 5 is a top view of the apparatus shown in FIG. 1.

A pair of wheels 16L and 16R (see also FIG. 5) are shown resting on the ground plane GP and are rotatably mounted on an axle means 15 connected to end 12L" of frame member 12L and the corresponding end of frame element 12R which, with L", define a second end of frame 12.

A first vertically-oriented box frame assembly 20 is pivotally attached to the second end of the carriage frame 12 for limited relative rotation therewith about a first pivotal axis. More specifically, frame assembly 20 comprises a pair of spaced apart, generally vertically-oriented members 20L and 20R, connected together with crossbraces 20AA, 20BB and 20CC (see FIG. 2). Crossbrace 20AA has bracket-like extensions at both ends thereof as is shown in FIG. 1, the ends of the brackets being pivotally connected as at 21' to a member 21 attached (as by welding) to the top surface of ends 12L" and to a corresponding structure at the corresponding end of frame element 12R.

A pair of hydraulic cylinders 22L and 22R, having respective piston rods 23L and 23R, are connected between the carriage frame 12 and the top end 20L" of box frame assembly 20. Thus, cylinder 22L is shown in FIG. 1 to be connected at 22L' to frame element 12L. Further, the piston rod 23L is connected at its outer extremity 23L' to a suitable bracket 21L attached to frame 20 at 20L'.

A second vertically-oriented trencher support or traveling frame assembly 26 is somewhat nested within the first vertically-oriented box frame assembly 20 and is adapted to be longitudinally movable therein. More specifically, as is shown in FIGS. 1 and 2, the second frame assembly or trencher support 26 comprises a left frame member 26L and a right frame member 26R connected by a crossbrace members 26AA, 28AA, 28BB and 28CC. Attached to the second vertically-oriented frame assembly 26 is a beam hanger 28 having vertically-oriented side elements 28L and 28R and transverse elements 28AA, 28BB and 28CC; frame 26 and beam hanger 28 are thus connected together and travel vertically with respect to box frame 20.

A pair of spaced apart, horizontal elongated beams 30L and 30R, the first ends of which are supported by frame 28 as is shown in FIG. 1; this support in the preferred embodiment is pivotal, as is depicted by pivot means 29 in FIG. 1. The other ends of beams 30L and 30R are connected by crossbraces 30AA and 30BB (see FIG. 4) which also form part of a support 33 shown in FIG. 1 for supporting a vertically oriented tubular member 34 having a top open end 35 for receiving flexible tile or tubing 36 and a lower end 37 to which is rotatably attached a crumber or boot means 40 having outlet means 40AA through which the flexible tubing 36 may travel. The boot or crumber 40 is further characterized by having bottom surfaces 44 and 45 joined as is shown in FIG. 4 to have a V-shaped profile, this arrangement facilitating the accuracy of the trenching operation. An idler wheel 46 is contained within the crumber 40 for facilitating the smooth passage therethrough of the tubing 36. The leading surface 42 of crumber 40 is an arcuate one, as is shown in FIG. 1, to generally mimic, on a spaced basis, the effective outer diameter of the driven sprocket and chain/cutter to be described below. Attached to the top open end 35 of tubular member 34 are (a) a shield 35A for shielding the open end from ingesting flying chunks C of earth discharged from cutters 63 to be described below, and (b) a roller means 35B to facilitate the easy entry of flexible tile 36 into tubular member 34.

A double-acting hydraulic cylinder 39 is attached to and is supported by the crossbrace 20BB of box frame 20 (see FIG. 2) and has a piston rod 39' attached as at 39" to crossbrace 26AA of the second vertically-oriented frame assembly 26. Cylinder 39 is thus a hoisting means for hoisting frame assembly 26 (and thus frame 28, beams 30L and 30R, and tubular member 34, as well as the driven sprocket assembly to be described below). A chain CH is connected at one end CH" thereof to crossbrace 20BB and extends upwardly to pass over an idler 26AA' (rotatably mounted on crossbrace 26AA) and thence downwardly to be connected at the other end CH' to crossbrace 28AA.

A hanger bearing and knuckle support box frame 27 is connected to the assembled trencher support frame assembly 26 and beam hanger 28 (see FIG. 2); frame 27 comprises a vertically-oriented element 27' attached as by welding to element 28R and further pivotally mounts and hanger 27" as is shown in FIG. 2.

The trenching apparatus further comprises a drive sprocket 70 having a plurality of sprocket teeth 71 driven via the output 72A of a gearbox 72 which is supported by the beams 30L and 30R.

A driven sprocket support means is provided. More specifically, an opened-ended box-like housing 50 is attached to beams 30L and 30R; it slidably houses a driven sprocket support beam 55 which is shown to be generally vertically-oriented and has at its lower end a pair of spaced apart or forked portions 55L and 55R (see FIG. 2). Suitable bearing means such as pillow block means 57 are provided at the lower extremities of 55L and 55R and provide a rotatable mount for a driven sprocket 60 having a plurality of teeth 61. It will be noted that as depicted, the driven sprocket 61 is a relatively large diameter as compared to the relatively small diameter of the drive sprocket 70. In the preferred embodiment of the invention, the driven sprocket 60 is six feet in diameter, has an axial thickness of 1.5 inches, and is made of tough steel. The teeth 61 have a pitch of 4.0 inches. Thus, the driven sprocket 60 is heavy and, once rotating, has a significant, beneficial rotating inertia or fly wheel effect. Also the generous axial thickness yields a rigid (non-flexing) cutter platform which produces a preferred narrow and straight trench.

A continuous chain 62 interconnects the drive sprocket 70 with the driven sprocket 60. A plurality of earth cutters 63 are attached to the chain 62 (see also FIG. 3).

A trough means TR is support by a bracket TR' (see FIG. 1) and is positioned to be spaced from and parallel to chain 62; its function is to block errant earth particles from falling on the driven sprocket 60.

Means are provided for driving the drive sprocket to thereby cause movement of the chain, cutters and driven sprocket. More specifically, the drive means includes a plurality of serially connected telescoped and splined shafts 75A, 75B and 75C, it being understood that power shaft 75A would be connected to an appropriate source of rotation such as a tractor power take-off as indicated on FIG. 1. Suitable means such as hanger bearing and knuckles connect shaft 75A to shaft 75B, and shaft 75B to shaft 75C. Thus in FIG. 1 a hanger bearing and knuckle 77 (connecting shafts 75A and 75B) is supported by a frame 69 comprising a member 77' pivoted at its top end to an upright brace 78 at 77"; brace 78 is further supported by a diagonal brace member 78'. For purposes of clarity, it should be understood that elements 75A, 77', 78 and 78' are not depicted in FIG. 2. Shafts 75B and 75C are connected by a hanger bearing and knuckle 77A supported by hanger 27" of box frame 27.

Shaft 75C is connected to the gearbox 72 through a slip clutch 76. Clutch 76 provides a slippage to protect the drive line if the cutters hit a rock or the like.

As indicated, box frame 27 is attached to the trencher support frame assembly 26. Thus, frame 27 travels up and down in unison with frame assembly 26; this facilitates an efficient coupling of the drive shafts 75A, 75B and 75C to the gearbox 72.

The invention further includes a pair of telescoping shock absorber means 80, connected as shown in FIG. 1, between the top of frame 28 and the other ends of beams 30L and 30R.

A hydraulic cylinder 85 is connected between beams 30L/30R at one end thereof and includes a piston rod connected at 85 to the driven sprocket support beam 55; cylinder 85 functions to maintain a preselected tension on the chain 62.

An adjustment means 90 is connected to the tubular member 34 and the crumber member 40 to provide a means of adjusting the vertical orientation of crumber 40 with respect to the tubular member 34.

Referring again to FIG. 1, the driven sprocket 60 with chain and cutters is shown to be removing earth to form a trench T at an elevation below the ground plane GP. The direction of rotation of the driven sprocket is indicated. Also depicted in FIG. 1 are a number of chunks or pieces of earth C being thrown from the cutter teeth 63 as the teeth pass around the relatively small diameter drive sprocket 70; this is an important feature of the present invention. Because the drive sprocket is relatively small in diameter, the chain with attached cutters 63 must make a rapid change in orientation and this creates a dynamic effect resulting in the dirt being thrown from the cutters; in practice a very significant percentage of the dirt and chunks C are thrown into the trench T as shown in FIG. 1. This has been found effective even with the soil being a heavy clay-like material.

In operation, it will be understood that the cylinders 39, 22L and 22R, and 85R, controlled by suitable means (not shown) such as hydraulic hoses connected to the tractor which is pulling the apparatus. The apparatus has been depicted in a cutting or digging mode. It will be understood that the double-acting hydraulic cylinder 39 is controlled so as to adjust the relative longitudinal relationship between the vertically-oriented frame assemblies 20 and 26 (and thus control the relative vertical orientation of the driven sprocket 60 and the chain and cutters 63). Thus the driven sprocket may be lowered much lower than the position shown in FIG. 1 to dig a deeper trench T as may be desired. A trench 8 feet deep can be achieved with the illustrated embodiment of our invention, using a driven sprocket 60 having a 6 foot diameter. The axial or transverse width of the trench T is set by the effective axial width of the cutters 63 on chain 62. The support beam 55 with forked portions 55L and 55R has a preselected width to fit within the trench cut by the apparatus.

When it is desired to move the apparatus from one location to another without the driven sprocket rotating, then the following procedure is used.

First, the hydraulic cylinder 39 is controlled so that the driven sprocket is raised upwardly to the limit of travel. Then the transport permitting hydraulic cylinders 22L and 22R are operated to cause frames 20 and 26 to pivot about pivot point 21' clockwise as shown in FIG. 1 to the dotted line position. At this time, the chain 62 and lowermost cutters and crumber surfaces 44 and 45 are raised above the groundplane GP.

The self-cleaning features of the present invention are the result of having a relatively large diameter driven sprocket wheel linked by chain 62 to a relatively small diameter drive sprocket which, in combination with an appropriate rotational speed of the drive sprocket, results in the chain with attached cutters having a relatively fast angular acceleration as the chain passes around the drive sprocket; the aforesaid angular acceleration tends to throw off the earth held by the cutters in a direction so as to fall into the trench behind the trenching apparatus.

Automatic level controls not specifically shown may include a laser beam response unit linked to control of hydraulic cylinder 39. It will also be understood that the apparatus will be controlled to obtain a desired preselected slope of the bottom of the trench; a slope of 2% is typical for drainage tile.

Another operational step in the trenching of a trench is to commence with a back-hoe or equivalent to dig an initial hole, and lay and secure therein one end of the flexible tile. The driven sprocket assembly and the crumber are then lowered into the initial hole and the precise narrow trenching can begin. The secured end of the flexible tile functions as an anchor to thus effectively pull the flexible tile through tube 34 as the apparatus 10 moves along the groundplane GP. The tile to be laid may be arranged out on top of the groundplane; five inch diameter flexible tile is available in 2,000 feet long rolls or spools.

While the preferred embodiment of the invention has been illustrated, it will be understood that variations may be made by those skilled in the art without departing from the inventive concept. Accordingly, the invention is to be limited only by the scope of the following claims.

What is claimed is:

1. A trenching apparatus for trenching a narrow trench in the earth and continuous laying of flexible tubing in said trench, and refilling said trench with removed earth material, said apparatus comprising:

a) an elongated carriage frame having drawbar means at a first end adapted to be connected to a pulling vehicle and wheel means at a second end to enable horizontal travel of said carriage frame over a groundplane;

b) a first vertically-oriented frame assembly pivotally attached to said second end of said carriage frame for relative rotation therewith about a first pivotal axis;

c) a second vertically oriented frame assembly longitudinally movably nested within said first vertically-oriented frame;

d) a grade setting and hoisting hydraulic cylinder connected to said first vertically oriented frame assembly, having a piston connected to said second vertically-oriented frame assembly, and adapted when actuated to move said second vertically-oriented frame assembly longitudinally with respect to said first vertically-oriented frame assembly;

e) a pair of spaced apart, horizontal elongated beams pivotally supported at first ends thereof by said second vertically-oriented frame assembly and having second ends;

f) a drive sprocket supported by said horizontal beams, said drive sprocket having a diameter;

g) a driven sprocket support beam vertically oriented and adjustably connected to and supported by said horizontal beams;

h) a driven sprocket rotatably connected to one end of said driven sprocket support beam, said driven sprocket having high inertia and a diameter larger than said drive sprocket diameter;

i) a continuous chain connecting said sprockets, said chain having attached thereto a plurality of earth cutters;

j) means for driving said drive sprocket to thereby cause movement of said chain and cutters, and rotation of said driven sprocket;

k) a vertically-oriented tubular member having a top end for receiving flexible tubing and being supported by said horizontal beams at said second ends thereof; and l) crumber means attached to a bottom end of said vertically-oriented tubular member for placing flexable tubing in said trench and including outlet means through which said flexible tubing may travel.

2. Apparatus of claim 1 further characterized by including transport hydraulic means connected between said carriage frame and said first vertically-oriented frame assembly and adapted, when actuated, to move said vertically oriented frame assembly about said first pivotal axis and to thereby facilitate upward movement of said horizontal elongated beams, said driven sprocket support beam, and said vertically-oriented tubular member to thereby raise said chain, cutters, and said crumber above the ground plane.

3. Apparatus of claim 1 further including a plurality of connected power shafts having a first end adapted to be connected to power take-off means and a second end adapted to be connected to said drive sprocket.

4. Apparatus of claim 3 wherein said second end of said plurality of connected power shafts is connected to a gear box having an output connected to said drive sprocket.

5. Apparatus of claim 4 wherein said plurality of connected power shafts are telescoping splined, and supported by hanger bearing and knuckles attached respectively to a) a vertical support frame attached to said carriage frame; and b) a vertical support frame attached to said second vertically oriented frame assembly.

6. Apparatus of claim 4 wherein said connection of said power shafts to said gear box includes a slip clutch.

7. Apparatus of claim 1 including a chain tension adjusting cylinder connected between said pair of horizontal beams and said driven sprocket support beam.

8. Apparatus of claim 1 wherein said cumber means includes a V-shaped bottom surface.

9. Apparatus of claim 1 further including telescoping lift arms connected between said second vertically oriented frame assembly and said second ends of said spaced apart horizontal elongated beams.

10. Apparatus of claim 1 further characterized by said chain and attached cutters being positioned laterally between said pair of spaced apart horizontal elongated beams.

11. Apparatus of claim 1 wherein said attachment of said crumber means to said bottom end of said vertically-oriented tubular member includes means for permitting rotation of said crumber means about the longitudinal axis of said tubular member.

12. A trenching apparatus for trenching a narrow trench in the earth and continuous laying of flexible tubing in said trench, said apparatus comprising:

a) an elongated carriage frame having drawbar means at a first end adapted to be connected to a pulling vehicle and wheel means at a second end to enable horizontal travel of said carriage flame;

b) a first vertically-oriented frame assembly attached to said second end of said carriage frame;

c) a second vertically oriented frame assembly movably attached to said first vertically-oriented frame;

d) grade setting and hoisting hydraulic cylinder means connected to said first and second vertically oriented frame assemblies, and adapted when actuated to move said second vertically-oriented frame assembly longitudinally with respect to said first vertically-oriented frame assembly;

e) a pair of spaced apart, horizontal elongated beams supported at first ends thereof by said second vertically-oriented frame assembly and having second ends;

f) a drive sprocket support by said horizontal beams, said drive sprocket having a diameter;

g) a generally vertically-oriented driven sprocket support beam connected to and supported by said horizontal beams;

h) a driven sprocket rotatably connected to one end of said driven sprocket support beam, said driven sprocket having a diameter larger than said drive sprocket diameter;

i) a continuous chain connecting and engaging said sprockets, said chain having attached thereto a plurality of earth cutters;

j) means for driving said drive sprocket to thereby cause movement of said chain and cutters, and rotation of said driven sprocket;

k) a vertically-oriented tubular member having a top open end for receiving flexible tubing and being supported by said horizontal beams at said second ends thereof; and l) crumber means attached to a bottom end of said vertically-oriented tubular member for placing flexible tubing in said trench and including outlet means through which said flexible tubing may exit said apparatus.

13. Apparatus of claim 12 further characterized by including transport hydraulic means connected between said carriage frame and said first vertically-oriented frame assembly and adapted, when actuated, to move said vertically oriented frame assembly about a first pivotal axis to thereby facilitate upward movement of said horizontal elongated beams, said driven sprocket support beam, and said vertically-oriented tubular member to thereby raise said chain, cutters, and said crumber means above the ground plane.

* * * * *